US007905289B2

(12) United States Patent
Budney et al.

(10) Patent No.: US 7,905,289 B2
(45) Date of Patent: Mar. 15, 2011

(54) DOUBLE-ACTING JAR COMPOUNDER

(76) Inventors: David Budney, Edmonton (CA); Craig Budney, Edmonton (CA); Glenn Budney, Edmonton (CA)

( * ) Notice: Subject to any disclaimer, the term of this patent is extended or adjusted under 35 U.S.C. 154(b) by 10 days.

(21) Appl. No.: 12/136,932

(22) Filed: Jun. 11, 2008

(65) Prior Publication Data

US 2009/0308593 A1 Dec. 17, 2009

(51) Int. Cl.
*E21B 31/113* (2006.01)

(52) U.S. Cl. ..... 166/301; 166/178; 175/296

(58) Field of Classification Search ..... 166/301, 166/178; 175/296
See application file for complete search history.

(56) References Cited

U.S. PATENT DOCUMENTS 3,955,634 A 5/1976 Slator et al.
3,987,858 A 10/1976 Slator et al.
5,139,086 A * 8/1992 Griffith, Sr. ..... 166/178
5,318,139 A * 6/1994 Evans ..... 175/297
5,431,221 A 7/1995 Roberts et al.
5,584,353 A 12/1996 Chancey et al.
5,918,689 A * 7/1999 Roberts ..... 175/297
5,931,242 A * 8/1999 Oettli ..... 175/296
6,202,767 B1 * 3/2001 Friis ..... 175/297
2005/0284665 A1 12/2005 Shears et al.

* cited by examiner

*Primary Examiner* — William P Neuder
(74) *Attorney, Agent, or Firm* — Frank J. Dykas; Scott D. Swanson; Dykas & Shaver LLP

(57) ABSTRACT

A double-acting compounder is disclosed having a first end and a second end, and comprising an outer housing, an upper mandrel, and a lower mandrel. The outer housing defines the first end. The upper mandrel is at least partially disposed telescopically within the outer housing to define an uphole fluid chamber between the upper mandrel and the outer housing, the upper mandrel defining the second end. The lower mandrel is at least partially disposed telescopically within the outer housing to define a downhole fluid chamber between the lower mandrel and the outer housing. The uphole fluid chamber and the downhole fluid chamber each contain fluid, have a variable stroke-dependent volume, and are sealed at an uphole end and a downhole end. The upper mandrel has a first shoulder engagable with and facing a second shoulder of the lower mandrel to move the lower mandrel during at least a portion of a stroke.

18 Claims, 8 Drawing Sheets

DOUBLE-ACTING JAR COMPOUNDER

TECHNICAL FIELD

This document relates to compounders, in particular to double-acting compounders.

BACKGROUND

Compounders are used in tandem with jarring devices in order to enhance the jarring impact of the jarring device. Compounders use inner spring mechanisms in order to store the additional energy that is released to increase the jar. U.S. Pat. No. 5,931,242 describes a compounder that incorporates a movable piston disposed within a fluid chamber between inner and outer cylindrical assemblies to provide compounding in either jarring direction.

SUMMARY

A double-acting compounder is disclosed having a first end and a second end, and comprising an outer housing, an upper mandrel, and a lower mandrel. The outer housing defines the first end. The upper mandrel is at least partially disposed telescopically within the outer housing to define an uphole fluid chamber between the upper mandrel and the outer housing, the upper mandrel defining the second end. The lower mandrel is at least partially disposed telescopically within the outer housing to define a downhole fluid chamber between the lower mandrel and the outer housing. The uphole fluid chamber and the downhole fluid chamber each contain fluid, have a variable stroke-dependent volume, and are sealed at an uphole end and a downhole end. The upper mandrel has a first shoulder engagable with and facing a second shoulder of the lower mandrel to move the lower mandrel during at least a portion of a stroke.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figures 1A, 1B, 1C:
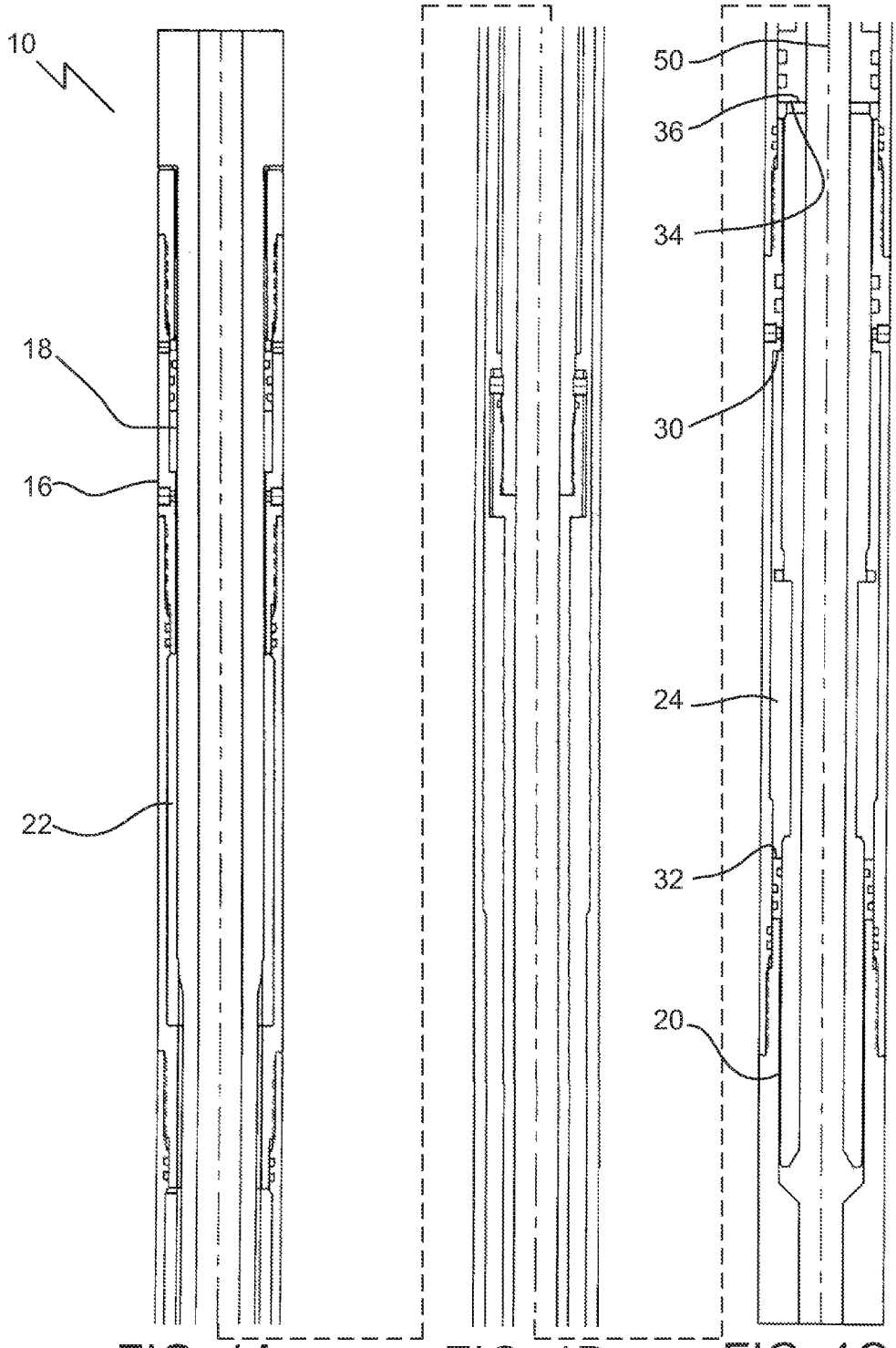
FIGS. 1A-C is an exploded side elevation view, in section, of a double-acting compounder fully compressed.

Immaterial modifications may be made to the embodiments described here without departing from what is covered by the claims.

Jars provide a large transient force impact to a tubing string in either an upward or downward direction. A jar may have, for example, an inner tubular disposed within an outer tubular, defining a chamber in between the two. The chamber may contain hydraulic fluid in the form of gas or liquid, for example. In some cases, a mechanical spring may be used. A tensile or compressive force is applied, through the tubing string, to either the outer tubular or the inner tubular of the jar, forcing the outer tubular and inner tubular to move relative to one another. The relative movement between the two is initially restricted within the chamber, such that the energy of the tensile or compressive force builds up in the tubing string. As soon as the outer tubular and inner tubular move far enough relative to one another to clear the initial restriction, the energy built up in the tubing string is transferred into rapid relative motion between the inner tubular and the outer tubular. Jarring shoulders on both the inner tubular and outer tubular then impact one another, releasing a large amount of kinetic energy into the tubing string and causing a striking blow to the tubing string.

A double-acting compounder may be used with a double-acting jar, in order to compound the jarring force of the jar in both directions. A compounder may be connected, for example, either directly or indirectly to the jar in the tubing string. By applying a compressive or tensile force to the tubing string, the compounder uses, for example, a fluid or mechanical spring to allow additional force to be built up prior to the release of that force in either an up or a down jar. Compounders are useful additions with, for example, a coiled tubing jarring operation, because they allow additional force to be built up and stored in the compounder to be transferred during a jar, without imposing additional strain on the already limited compressive and tensile stress of the tubing string itself.

The double-acting compounder disclosed herein may be used with coiled tubing. Adapting such a tool to a coiled tubing application presents some challenges to overcome. A coiled tubing operation may involve, for example, the use of a single continuous pipe or tubing. The tubing, which is coiled onto a reel and uncoiled as it is lowered into the well bore, can be used for, for example, drilling or workover applications. However, coiled tubing presents a number of working constraints to existing tool design. First of all, due to the limited size of the coiled tubing, limited compressive loads can be placed on the tubing by the rig operator. Essentially, this means that downhole tools which require compressive force to operate, such as a jarring tool, must be capable of operating with the limited compressive load capability of coiled tubing. In addition, in coiled tubing application the overall length of the downhole tool becomes significant since there is limited distance available between the stuffing box and the blowout preventor to accommodate the bottom hole assembly. A typical bottom hole assembly may include, for example, a quick disconnect, a sinker bar located below the quick disconnect to provide weight to the bottom hole assembly, the jar, a release tool below that of some type, and then an overshot. Other tools may also be present, as required. Thus, the length of any tool used itself becomes particularly significant since the entire bottom hole assembly may be required to fit within the limited distance between the stuffing box and blowout preventor to introduce it into a pressurized well. Furthermore, within these confines, the compounder may be required to have a large enough internal bore to permit pump-down tools to pass. Thus, the coiled-tubing compounder may have a limited overall wall thickness in view of limited outer diameter conditions.

As in the case with conventional drill pipe, coiled tubing or other down hole tools, these items may get stuck in the well bore at times. Under these circumstances, repetitive upjarring or downjarring with a jarring tool may be useful. Many traditional double-acting jar tools do not perform this function, as upon resetting from a jar in one direction, only a jar in the opposite direction may be subsequently enacted. The double acting compounder disclosed herein allows a user to enhance the jarring force for a jar in either direction. Further, the double-acting compounder disclosed herein allows a user to subsequently repetitively jar in either direction. In some embodiments this compounder design may be adapted for use in a conventional drill string as well.

Figures 3A, 3B, 3C:
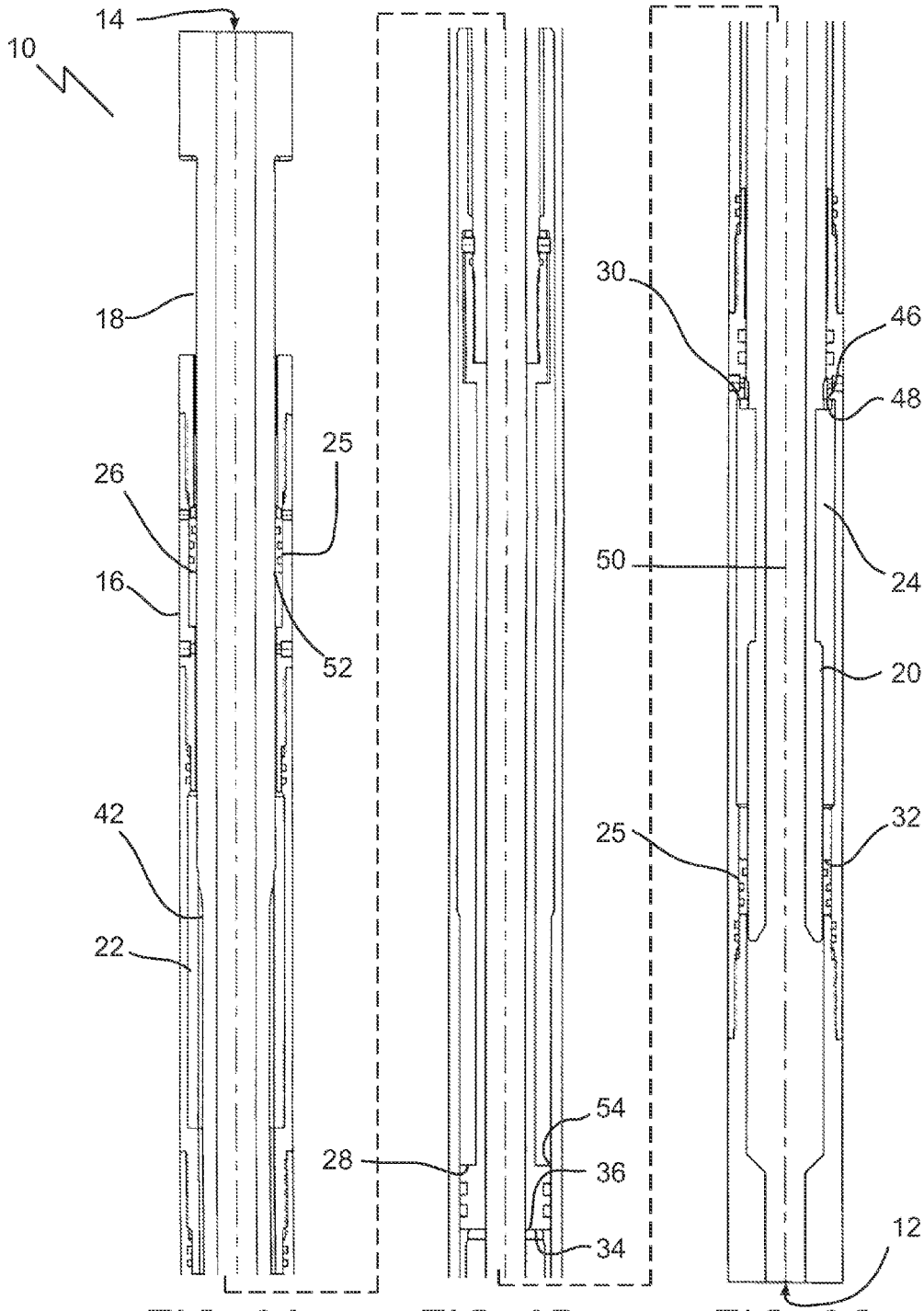
FIGS. 3A-C is an exploded side elevation view, in section, of the double-acting compounder of FIGS. 1A-C in a neutral position.

Referring to FIGS. 3A-C, a double-acting compounder 10 is illustrated comprising a first end 12, a second end 14, an outer housing 16, an upper mandrel 18, and a lower mandrel 20. Outer housing 16 defines first end 12 of compounder 10. Upper mandrel 18 is at least partially disposed telescopically within outer housing 16 to define an uphole fluid chamber 22 between upper mandrel 18 and outer housing 16. Upper mandrel 18 defines second end 14. First and second ends 12 and 14 refer to relative ends of compounder 10, and do not imply that one end must always be oriented downhole of the other end. In some embodiments, first end 12 may be connected, directly or indirectly, to a tubing string (not shown), while second end 14 is connected, directly or indirectly, to a jarring tool (not shown). In other embodiments, this orientation is reversed. A skilled worker would understand that compounder 10 could be oriented upside down in a well, and could still carry out the function of the compounder.

Figure 8:
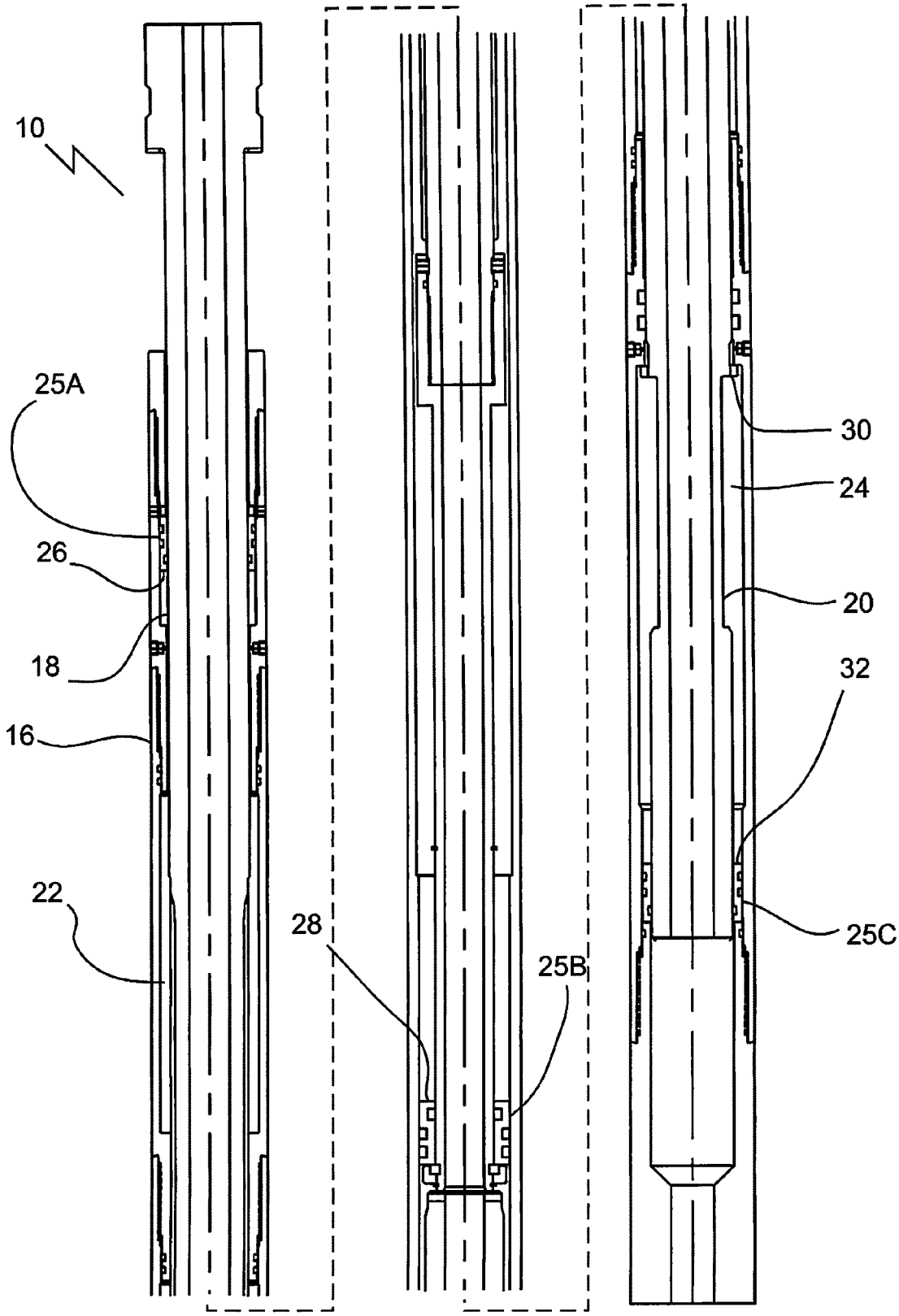
FIG. 8 is an exploded side elevation view, in section, of another embodiment of a double-acting compounder in a neutral position.
Figure 9:
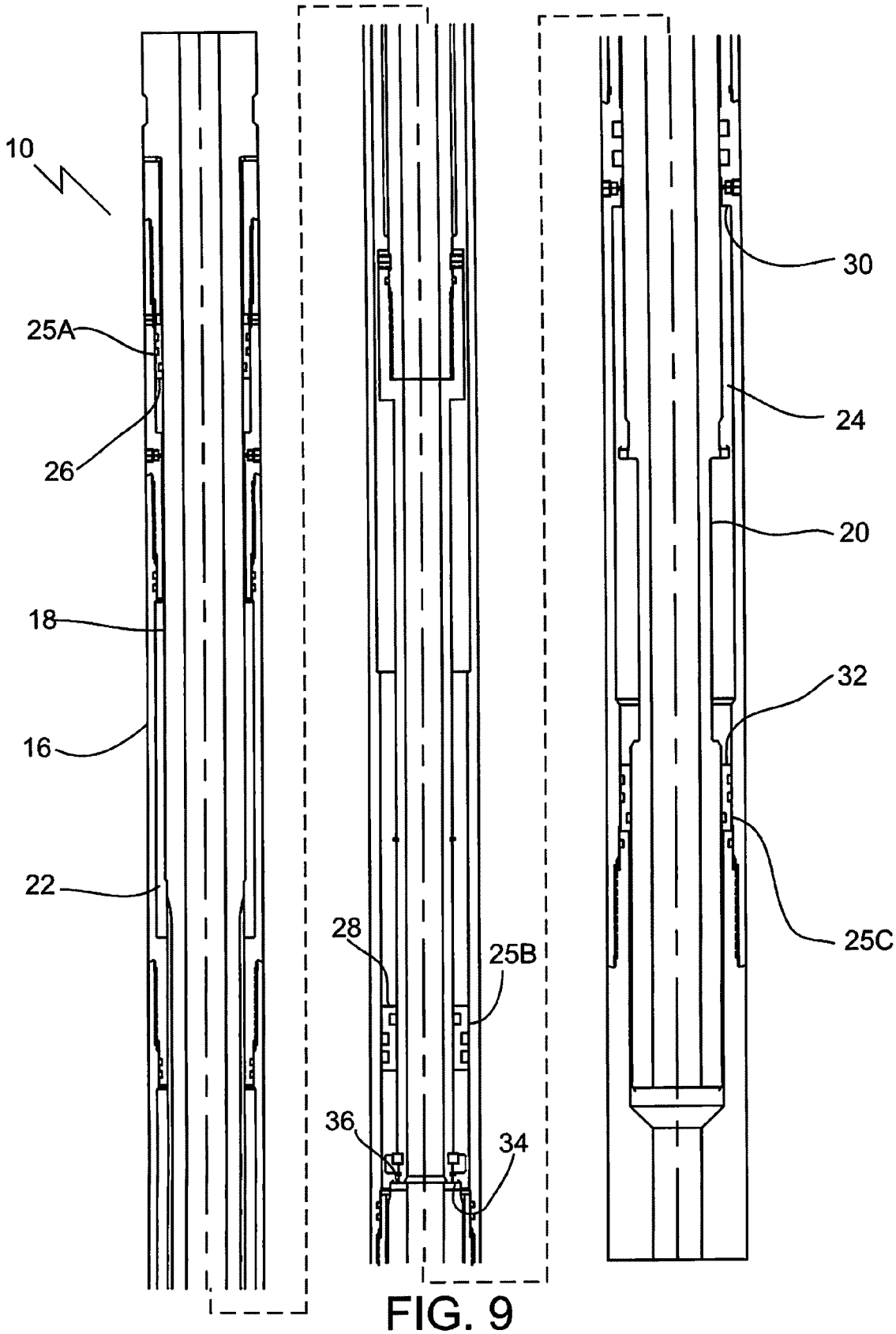
FIG. 9 is an exploded side elevation view, in section, of the double-acting compounder of FIG. 8 fully compressed.
Figure 10:
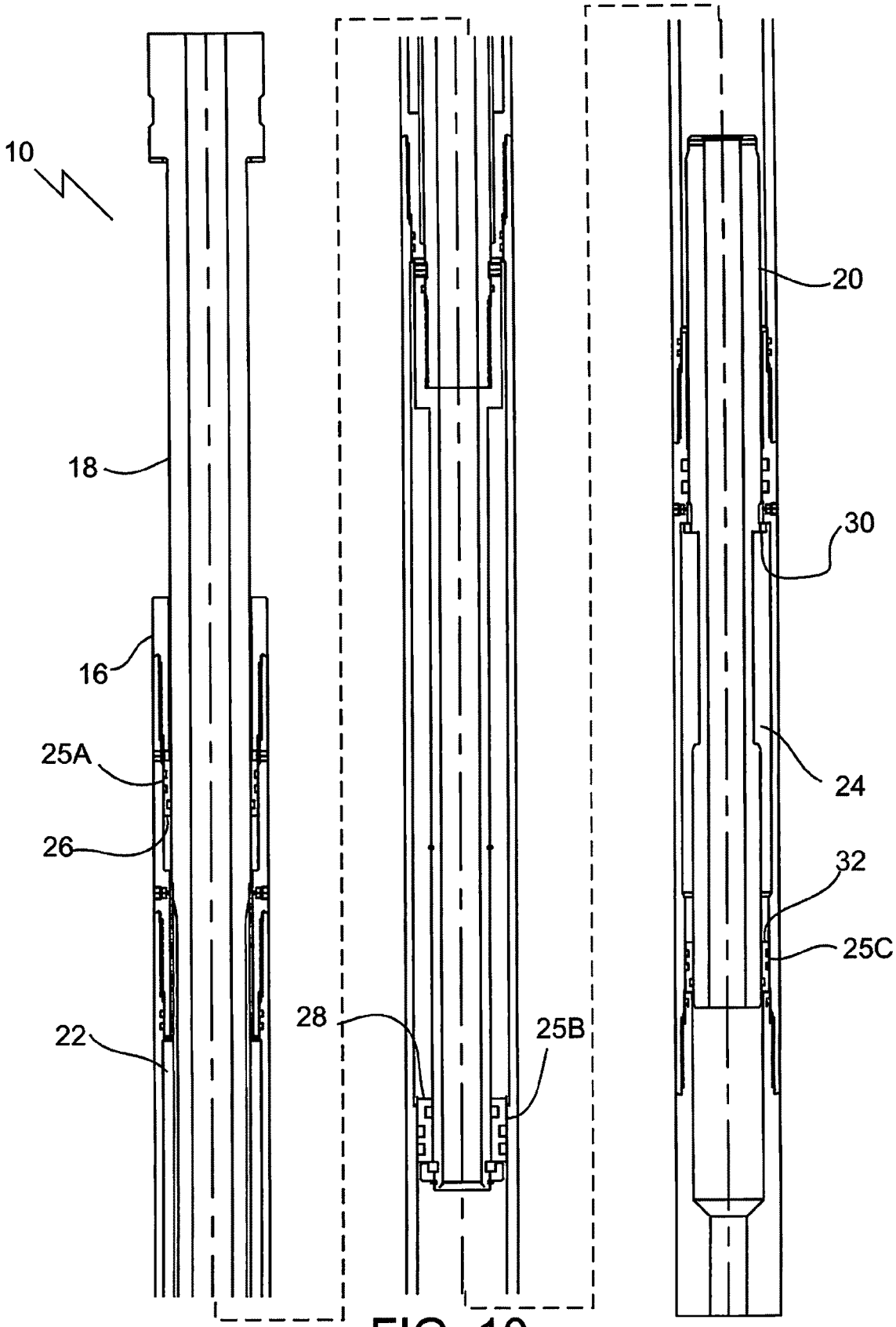
FIG. 10 is an exploded side elevation view, in section, of the double-acting compounder of FIG. 8 fully extended.

Lower mandrel 20 is at least partially disposed telescopically within outer housing 16 to define a downhole fluid chamber 24 between lower mandrel 20 and outer housing 16. In some embodiments, lower mandrel 20 is disposed entirely within outer housing 16. Uphole fluid chamber 22 and downhole fluid chamber 24 each contain fluid, have a variable stroke-dependent volume, and are sealed at uphole ends 26, 30, and downhole ends 28, 32, respectively. Variable stroke-dependent volume refers to the fact that, for example, due to the respective dimensions of upper mandrel 18 and outer housing 16 that define uphole fluid chamber 22, relative longitudinal movement between upper mandrel 18 and outer housing 16 acts to increase the volume of uphole fluid chamber 22 in one direction, and decrease the volume in the other direction. Similarly, due to the respective dimensions of lower mandrel 20 and outer housing 16 that define downhole fluid chamber 24, relative longitudinal movement between lower mandrel 20 and outer housing 16 acts to increase the volume of downhole fluid chamber 24 in one direction, and decrease the volume in the other direction. This way, motion in one direction will expand the volume, and thus the fluid contained within, and motion in the other direction will compress the volume and thus the fluid contained within. Energy may be stored in chambers 22 and 24 during either expansive or compressive movements. The fluid contained within uphole and downhole fluid chambers 22 and 24 may be, for example, hydraulic fluid. In some embodiments, the fluid may be compressible, for example compressible hydraulic liquid. The fluid creates a fluid spring within chambers 22 and 24, in which the jar compounding energy may be stored to enhance the jarring impact. A floating seal 25 may be present at least one of uphole end 26, 30 and downhole end 28, 32 of at least one of uphole fluid chamber 22 and downhole fluid chamber 24. In some embodiments, uphole fluid chamber 22 may comprise floating seal 25 at least one of uphole and downhole ends 26 and 28, respectively. Downhole fluid chamber 24 may comprise floating seal 25 (FIGS. 3A-C), 25A, 25B, 25C (FIGS. 8-9) at least one of uphole and downhole ends 30 and 32, respectively. Floating seal 25 allows pressure differentials between either or both of chambers 22 and 24 and outside of compounder 10 to equalize. This may prevent, for example, either or both of chambers 22 and 24 from collapsing under the extreme fluid pressures that may be experienced downhole. Either or both of chambers 22 and 24 may be annular in shape. In some embodiments, there may be one or more of either or both chambers 22 and 24 (plural fluid chambers), each one operating according to the embodiments disclosed herein for compounding operation. At least one of upper mandrel 18, lower mandrel 20, and outer housing 16 may be individually composed of, for example, one or more units connected together. Each unit may be, for example, threadably connected together as is well known in the art, and as is illustrated in the figures. At least one of outer housing 16, upper mandrel 18, and lower mandrel 20 may be, for example, tubulars.

Figure 4:
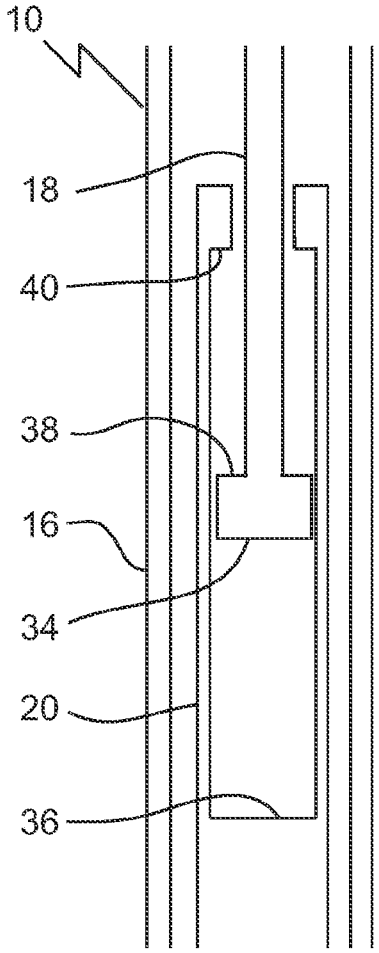
FIG. 4 is a partial side elevation view, in section of an embodiment of a shoulder configuration for a double-acting compounder.

Upper mandrel 18 has a first shoulder 34 engagable with and facing a second shoulder 36 of lower mandrel 20 to move lower mandrel 20 during at least a portion of a stroke. Referring to FIGS. 1A-C, in some embodiments, first shoulder 34 is downhole facing, second shoulder 36 is uphole facing, and first shoulder 34 is engagable with second shoulder 36 to move lower mandrel 20 during at least a portion of a downstroke. The sequence from FIGS. 3A-C to 1A-C illustrates an embodiment where this occurs. In other embodiments, first shoulder 34 may be uphole facing, second shoulder 36 may be downhole facing, and first shoulder 34 is engagable with second shoulder 36 to move lower mandrel 20 during at least a portion of an upstroke. Referring to FIG. 4, in some embodiments, upper mandrel 18 further comprises an uphole facing shoulder 38 engagable with and facing a downhole facing shoulder 40 of lower mandrel 20 to move lower mandrel 20 during at least a portion of the upstroke.

Referring to FIGS. 3A-C, compounder 10 may further comprise an alignment spline 42 between upper mandrel 18 and outer housing 16. In some embodiments, compounder 10 may further comprise an alignment spline (not shown) between lower mandrel 20 and outer housing 16. The alignment splines aid to restrict any relative axial rotation between mandrels 18, 20, and outer housing 16.

Referring to FIGS. 3A-C, compounder 10 may further comprise restriction shoulders 46 and 48 in downhole fluid chamber 24 on lower mandrel 20 and outer housing 16, respectively. Restriction shoulders 46, 48 are configured to face one another and collide to restrict the longitudinal movement of lower mandrel 20 within outer housing 16. Referring to FIGS. 3A-C, restriction shoulders 46, 48 are facing one another to collide and restrict the longitudinal upward movement of lower mandrel 20 within outer housing 16. This prevents lower mandrel 20 from moving upward past a predefined point into an upstroke. In some embodiments, restriction shoulders 46, 48 face one another to collide and restrict the longitudinal downward movement of lower mandrel 18 within outer housing 16. In other embodiments, there may be more than one set of restriction shoulders. In some embodiments, at least one set of restriction shoulders restricts longitudinal downward movement of lower mandrel 18 within outer housing 16, and at least one other set of restriction shoulders restricts longitudinal upward movement of lower mandrel 18 within outer housing 16.

Uphole fluid chamber 22 may be configured to increase or decrease in volume during downward movement relative to outer housing 16. Similarly, downhole fluid chamber 24 may be configured to increase or decrease in volume during downward movement relative to outer housing 16. In some embodiments, if the volume of one of chambers 22 or 24 is configured to expand during a downstroke, the volume of the other of chambers 22 or 24 will be configured to compress during a downstroke. This way, when upper mandrel 18 is in the process of moving lower mandrel 20, a down enhancement may be achieved. Due to the extreme pressures experienced downhole, the larger the reduction of pressure within a sealed chamber, the greater the pressure differential between the chamber and outside the compounder 10, and hence the greater the likelihood that compounder 10 may be crushed. In some embodiments, first shoulder 34 is engagable with second shoulder 36 to move lower mandrel 20 during at least a portion of a downstroke. In this embodiment, downhole fluid chamber 24 may be configured to decrease in volume during a downstroke, in order to create the downstroke compounding force by a combination of the expansion of fluid in uphole fluid chamber 22 and the compression of fluid in downhole fluid chamber 24, although the contribution from the expansion of chamber 22 is relatively small. This way, uphole fluid chamber 22 will be configured to decrease in volume during upward movement relative to outer housing. Thus, an up enhancement may be achieved by upward movement of upper mandrel 18 relative to outer housing 20, and a downstroke enhancement may be achieved by a combined downward movement of upper mandrel 18 and lower mandrel 20 relative to outer housing 16.

Figure 5:
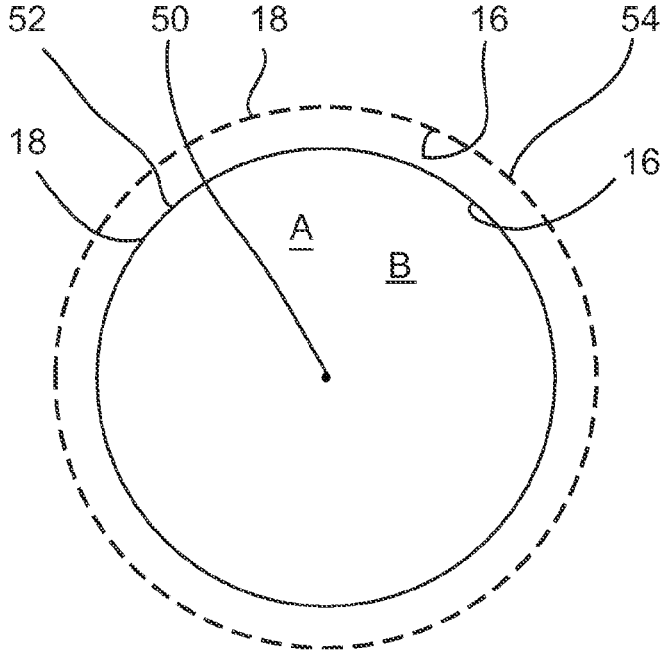
FIG. 5 is a cross sectional view illustrating the relationship between sealing interfaces in an annular fluid chamber.
Figure 6:
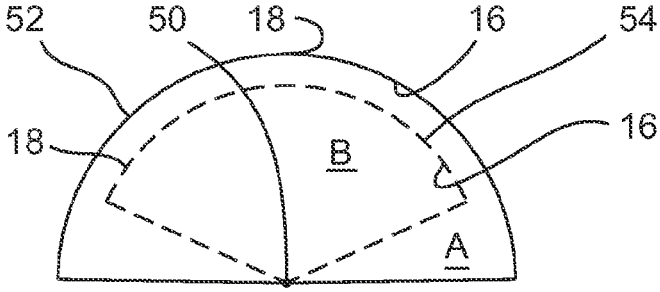
FIG. 6 is a cross sectional view further illustrating the relationship between sealing interfaces in a non-annular fluid chamber.
Figure 7:
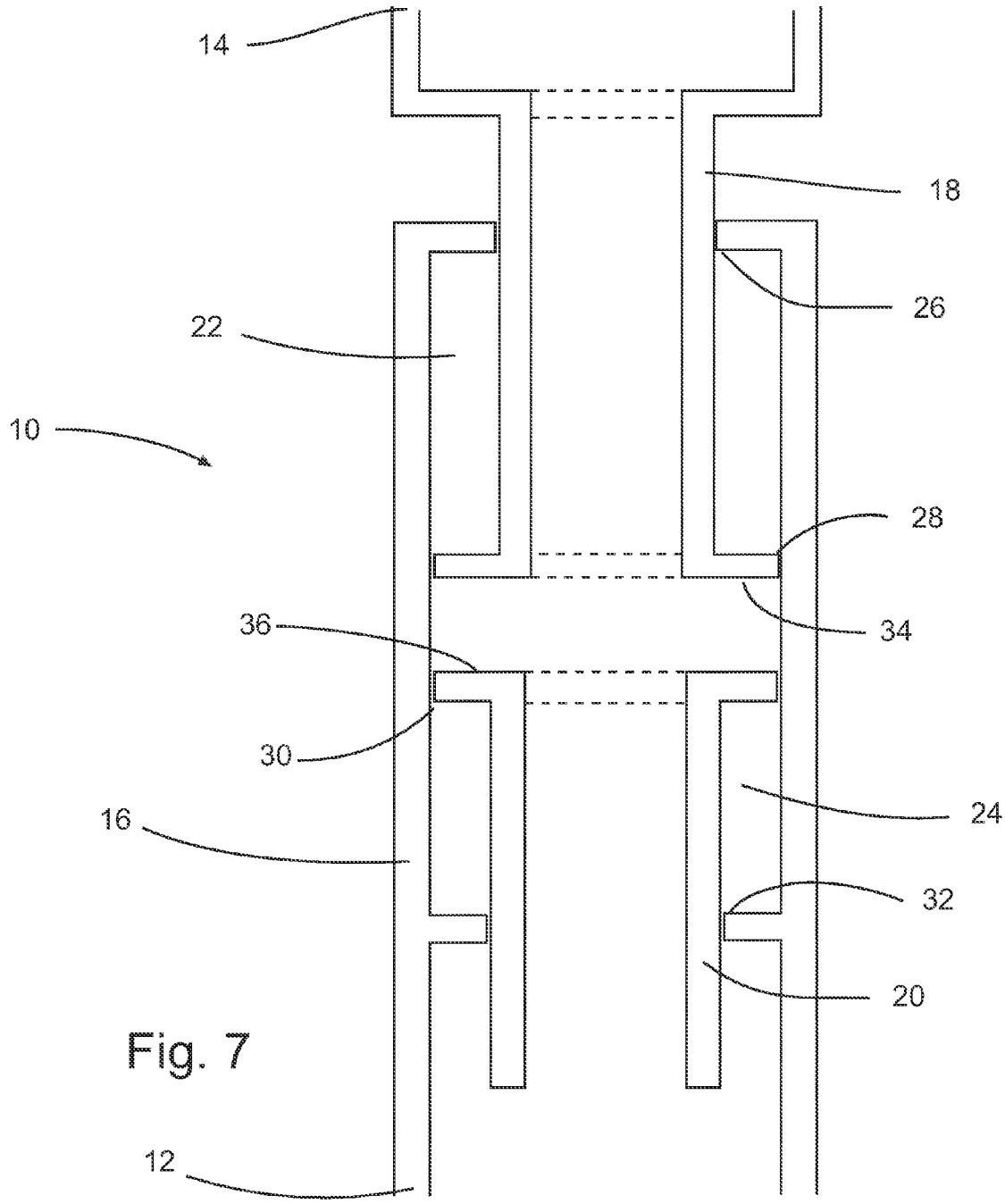
FIG. 7 is a schematic side elevation view, showing a simplified version of the double-acting compounder of FIGS. 1A-C.

Referring to FIGS. 3A-C, there are numerous ways in which either or both of chambers 22, 24 may be configured to have a variable stroke-dependent volume. For the purposes of this illustration, reference will be made to uphole fluid chamber 22, although it should be understood that downhole fluid chamber 24 contains the same elements, and functions under the same principles. Compounder 10 may have a longitudinal axis 50. Referring to FIGS. 3A-C and 5, a first sealing interface 52 may be defined between upper mandrel 18 and outer housing 16 at uphole end 26. Referring to FIG. 5, first sealing interface 52 may have a first cross-sectional area A defined between the first sealing interface 52 and the longitudinal axis 50. A second sealing interface 54 may be defined between upper mandrel 18 and outer housing 16 at downhole end 28. Second sealing interface 54 may have a second cross-sectional area B defined between second sealing interface 54 and the longitudinal axis 50. In an annular chamber, areas A and B may be the area of a circle defined by interfaces 52 and 54, respectively as illustrated. Sealing interfaces 52 and 54 are defined as the interface between upper mandrel 18 and outer housing 16 across which a portion of upper mandrel 18 is able to sealably cross during axial motion relative to outer housing 16. Because these interfaces need not be defined along a transverse cross section at either end, areas A and B need not be defined along an exact transverse cross-section at either end. Rather, they should be defined as the area of a projection of the respective sealing interfaces onto a transverse cross section. Referring to FIG. 5, if first and second cross-sectional areas A and B are different from one another, then relative movement between upper mandrel 18 and outer housing 16 will change the volume of uphole fluid chamber 22. In the embodiment illustrated in FIG. 5, assuming that second sealing interface 54 is positioned into and underneath the page, and first sealing interface 52 is positioned on the page, movement of upper mandrel 18 into the page relative to outer housing 16 will increase the volume of uphole fluid chamber 22, since area B is larger than area A. Referring to FIG. 6, a similar interface to interface relationship is illustrated with a non-annular fluid chamber 22. Because area A is larger than B, movement of upper mandrel 18 into the page relative to outer housing 16 will decrease the volume of uphole fluid chamber 22.

Figures 2A, 2B, 2C:
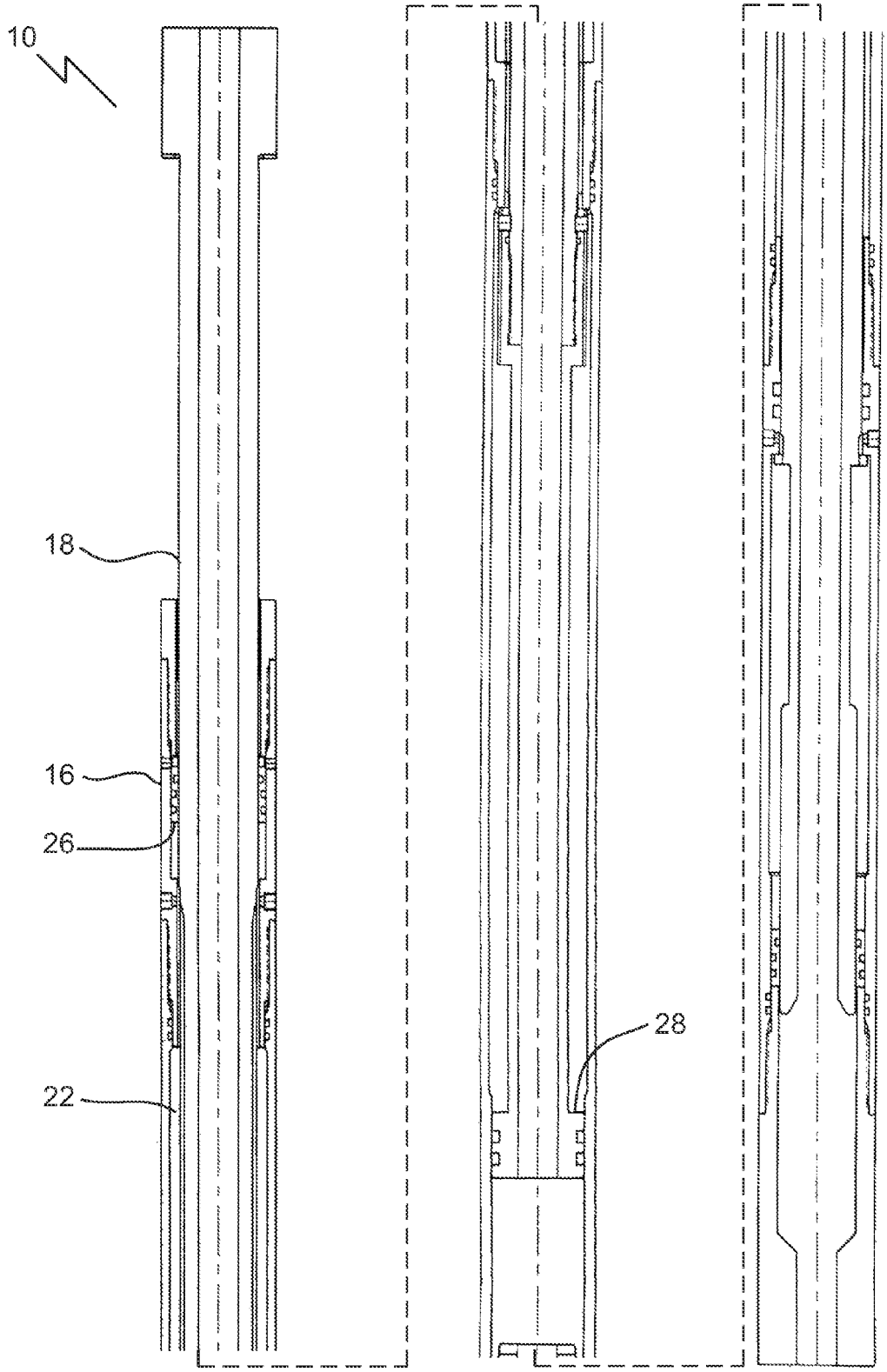
FIGS. 2A-C is an exploded side elevation view, in section, of the double-acting compounder of FIGS. 1A-C fully extended.

The operation of one embodiment of compounder 10 will now be described. Referring to FIGS. 3A-C, compounder 10 is positioned in a neutral position. Compounder 10, in this scenario, will be understood to be connected to a tubing string in association with a double-acting jarring tool. If a user wishes to carry out an upjar, a tensile force is introduced on the tubing string. Referring to FIGS. 2A-C, upper mandrel 18 is drawn upwards relative to outer housing 16. Because cross-sectional area B at downhole end 28 is larger than cross-sectional area A at uphole end 26, the volume of uphole fluid chamber 22 is reduced, compressing the fluid contained within. This compression of chamber 22 stores tensile energy, and as the jar used in association with compounder 10 clears the restriction and moves to upjar, the tension between outer housing 16 and the jar is reduced, allowing outer housing 16 to move upward relative to upper mandrel 18, releasing the energy stored in fluid chamber 22 into the tubing string, and thus into the upstroke. Referring to FIGS. 3A-*c*, after the upstroke, upper mandrel 18 is biased back into a neutral position by the fluid contained within uphole fluid chamber 22. If a user wishes to carry out a downjar, compression is introduced into the tubing string. Referring to FIGS. 1A-C, under compression, due to compressive force between outer housing 16 and the jar, upper mandrel 18 is moved downward relative to outer housing 16. As upper mandrel 18 is moved downward, the volume of uphole fluid chamber 22 is increased, expanding any fluid contained within, and storing energy in the fluid. First shoulder 34 contacts second shoulder 36 of lower mandrel 20, and lower mandrel 20 begins to move downward relative to outer housing 16 along with upper mandrel 18. Because cross-sectional area B of downhole end 32 is smaller than cross-sectional area A of uphole end 30 (both areas A and B now referring to downhole fluid chamber 24), as lower mandrel 16 moves downward relative to outer housing 16, the volume of downhole fluid chamber 24 is reduced, compressing the fluid contained within and storing compressive energy inside the fluid. As soon as the jar clears the restricted movement portion, and moves rapidly to downjar, the tension between outer housing 16 and the jar is released, effectively allowing outer housing 16 to move downward relative to lower mandrel 20 and upper mandrel 18 back to neutral. Upon this downward movement, the energy stored within chambers 22 and 24 is released into the jar to enhance the impact of the downjar.

Compounder 10 of the type disclosed herein may be used in, for example, fishing operations, drilling operations, coiled tubing, and drill strings. The use of up or down in this document illustrates relative motions within compounder 10, and are not intended to be limited to vertical motions, or upward and downward motions. It should be understood that compounder 10 may be used in any type of well, including, for example, vertical, deviated, and horizontal wells.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A double-acting compounder having a first end and a second end, comprising:

an outer housing defining the first end;

an upper mandrel at least partially disposed telescopically within the outer housing to define an uphole fluid chamber between the upper mandrel and the outer housing, the upper mandrel defining the second end;

a lower mandrel at least partially disposed telescopically within the outer housing to define a downhole fluid chamber between the lower mandrel and the outer housing;

the uphole fluid chamber and the downhole fluid chamber each containing fluid, having a variable stroke-dependent volume, and being sealed at an uphole end and a downhole end; and the upper mandrel being movable relative to the lower mandrel and having a first shoulder engagable with and facing a second shoulder of the lower mandrel to move the lower mandrel during at least a portion of a stroke.

2. The double-acting compounder of claim 1 in which the first shoulder is downhole facing, the second shoulder is uphole facing, and the first shoulder is engagable with the second shoulder to move the lower mandrel during at least a portion of a downstroke.

3. The double-acting compounder of claim 2, further comprising restriction shoulders in the downhole fluid chamber on the lower mandrel and the outer housing, respectively, the restriction shoulders facing one another to collide and restrict the longitudinal upward movement of the lower mandrel within the outer housing.

4. The double-acting compounder of claim 2 in which the upper mandrel further comprises an uphole facing shoulder engagable with and facing a downhole facing shoulder of the lower mandrel to move the lower mandrel during at least a portion of an upstroke.

5. The double-acting compounder of claim 4, further comprising second restriction shoulders in the downhole fluid chamber on the lower mandrel and the outer housing, respectively, the second restriction shoulders facing one another to collide and restrict the longitudinal downward movement of the lower mandrel within the outer housing.

6. The double-acting compounder of claim 1 in which the first shoulder is uphole facing, the second shoulder is downhole facing, and the first shoulder is engagable with the second shoulder to move the lower mandrel during at least a portion of an upstroke.

7. The double-acting compounder of claim 6, further comprising restriction shoulders in the downhole fluid chamber on the lower mandrel and the outer housing, respectively, the restriction shoulders facing one another to collide and restrict the longitudinal downward movement of the lower mandrel within the outer housing.

8. The double-acting compounder of claim 1 in which the lower mandrel is disposed entirely within the outer housing.

9. The double-acting compounder of claim 1 further comprising a spline between the upper mandrel and the outer housing.

10. The double-acting compounder of claim 1, further comprising restriction shoulders in the downhole fluid chamber on the lower mandrel and the outer housing, respectively, the restriction shoulders facing one another and colliding to restrict the longitudinal movement of the lower mandrel within the outer housing.

11. The double-acting compounder of claim 1 in which downward movement of the lower mandrel reduces the volume of the downhole fluid chamber.

12. The double-acting compounder of claim 1 in which upward movement of the upper mandrel reduces the volume of the uphole fluid chamber.

13. The double-acting compounder of claim 1 further comprising a floating seal at least one of the uphole end and the downhole end of at least one of the uphole fluid chamber and the downhole fluid chamber.

14. The double-acting compounder of claim 1 used in a fishing operation.

15. The double-acting compounder of claim 1 used in a coiled tubing or drill string operation.

16. The double-acting compounder of claim 1 further comprising a floating seal at least one of the uphole end and the downhole end of the uphole fluid chamber.

17. The double-acting compounder of claim 1 further comprising a floating seal at least one of the uphole end and the downhole end of the downhole fluid chamber.

18. The double-acting compounder of claim 3 in which the restriction shoulders face one another to collide and define the neutral volume of the downhole fluid chamber when the downhole fluid chamber is filled with oil.

* * * * *